US007132807B2

(12) United States Patent
Zahornacky

(10) Patent No.: US 7,132,807 B2
(45) Date of Patent: Nov. 7, 2006

(54) MODEL TRAIN DIRECTION CONTROL DEVICE

(76) Inventor: Jon F. Zahornacky, 939 Wood Duck AV, Santa Clara, CA (US) 95051

( * ) Notice: Subject to any disclaimer, the term of this patent is extended or adjusted under 35 U.S.C. 154(b) by 0 days.

(21) Appl. No.: 11/240,077

(22) Filed: Sep. 30, 2005

(65) Prior Publication Data

US 2006/0071620 A1 Apr. 6, 2006

Related U.S. Application Data

(60) Provisional application No. 60/615,878, filed on Oct. 6, 2004.

(51) Int. Cl.
*H02P 1/54* (2006.01)

(52) U.S. Cl. ..... 318/53; 318/6; 318/16; 318/466; 446/410; 701/19; 246/187 A; 246/167 R

(58) Field of Classification Search ..... 318/6, 318/16, 53, 466; 191/46; 246/167 R, 187 A; 104/296; 701/19; 446/410
See application file for complete search history.

(56) References Cited

U.S. PATENT DOCUMENTS

| | | | | |
|---|---|---|---|---|
| 5,073,750 | A * | 12/1991 | Coron | 318/587 |
| 6,441,570 | B1 * | 8/2002 | Grubba et al. | 318/3 |
| 6,619,594 | B1 * | 9/2003 | Wolf et al. | 246/187 A |
| 6,655,640 | B1 * | 12/2003 | Wolf et al. | 246/167 R |
| 6,662,917 | B1 * | 12/2003 | Wolf et al. | 191/46 |
| 2003/0015626 | A1 * | 1/2003 | Wolf et al. | 246/187 A |
| 2005/0225425 | A1 * | 10/2005 | Zahornacky | 340/2.4 |
| 2005/0278086 | A1 * | 12/2005 | Neiser | 701/19 |
| 2006/0009117 | A1 * | 1/2006 | Severson | 446/410 |

* cited by examiner

*Primary Examiner*—Paul Ip
(74) *Attorney, Agent, or Firm*—Donald W. Meeker

(57) ABSTRACT

A model train on-board microprocessor provides basic lighting and motor operation and control. A socket provides a seamless instant remote control upgrade using industry standard remote control devices. The device provides new and useful functions and features for more prototypical operation by augmenting the industry standard remote control device capabilities. These new functions and features are made accessible from the remote control device companion transmitter with unique keypad sequences.

10 Claims, 4 Drawing Sheets

MICROPROCESSOR AND REMOTE CONNECTOR

MICROPROCESSOR AND REMOTE CONNECTOR

LAMP DRIVER CIRCUIT

MOTOR DRIVER CIRCUIT

POWER SUPPLY CIRCUIT

MODEL TRAIN DIRECTION CONTROL DEVICE

CLAIM OF PROVISIONAL APPLICATION RIGHTS

This application claims the benefit of U.S. Provisional Patent Application No. 60/615,878 filed on Oct. 6, 2004.

BACKGROUND OF THE INVENTION

1. Field of the Invention

This invention relates generally to the field of AC model train operation and in particular to a model train direction control for providing a unique "remote control ready" socket, allowing a seamless upgrade to remote control operation using an on-board microprocessor to operate the device in a non-remote environment providing basic direction control with speed monitoring and adjustment to maintain a constant speed of the model train under varying voltage and load conditions, and upon detection of an industry standard remote control device in the provided socket, will seamlessly switch the necessary signals to permit remote operation, including additional unique lighting and throttle features gained by the on-board microprocessor in coordination of signals with coded keyboard input using the industry standard remote control device.

2. Description of the Prior Art

Existing controls for model trains have a number of drawbacks. The existing technology does not provide a migration path for converting the basic operating controls of the locomotive to operate in a remote control environment without extensive wiring changes.

Industry standard remote controls have limited capabilities. The industry standard remote control device has limited 32-step motor throttle granularity, whereas 100-step motor granularity is much smoother operating. Additionally the industry standard remote control device cannot directly support LED's for lighting, only incandescent lamps.

The current technology does not provide the ability to maintain the same controls for constant speed under varying voltage and load conditions when conversion to a remote control environment is implemented.

SUMMARY OF THE INVENTION

A principal object of the present invention is to provide basic operation and seamless conversion of model trains to remote control operation with enhanced lighting and motor throttle granularity that will overcome the deficiencies of the prior art devices.

An object of the present invention is to provide a basic directional lighting and directional motor control device that can be locked in the forward or reverse direction.

Another object of the present invention is to provide a remote control ready socket connector that allows insertion of an industry standard remote control device.

Another object of the present invention is to provide an automatic detection mechanism that automatically switches lighting and motor controls to the inserted industry standard remote control device when present.

A related object of the present invention is to have a constant speed feature provided by the basic direction controller and seamlessly continue to provide this feature when the industry standard remote control device is inserted.

Another object of the present invention is to provide augmentation of lighting control provided by the industry standard remote control device that enables light emitting diodes (LED's) to be used for the directional lighting.

Another object of the present invention is to provide augmentation of motor control provided by the industry standard remote control device that enhances the throttle granularity for more prototypical operation.

Another object of the present invention is to provide a speed control servo that maintains model train speed under varying load and terrain conditions.

Another object of the present invention is to provide a mechanism to set the default 32-step throttle to the 100-step throttle augmentation by a unique key sequence from the companion industry standard remote control device transmitter.

Another object of the present invention is to provide configuration memory of the device that restores selected throttle step settings and default direction after track power loss.

In brief, In view of the limitations now present in the prior art, the present invention provides a new and useful capability for seamless conversion of non-remote control operation to remote control operation, adding functionality to lighting and motor operation, which is simpler in construction, more universally usable and more versatile in operation than known apparatus of this kind.

The purpose of the present invention is to provide a method to easily convert basic model train operation to remote control train operation with additional feature enhancements provided by on-board electronics providing for more functionality to lighting and motor operation for ultimate realism in operation. This device has many novel features not offered by the prior art apparatus that result in remote control operation, which is not apparent, obvious, or suggested, either directly or indirectly by any of the prior art apparatus.

The invention consists of a printed circuit board with various input and output connections. Inputs are attached to a power source, and outputs are attached to the various lights and motors in the model train. A 24-pin socket is provided for the industry standard remote control device. The invention is small, only 2.75" long by 1.25" wide, permitting installation into a wide variety of model train environments and scales.

The invention consists of a model train direction control device that operates autonomously supporting directional lighting and directional motor control for basic model train operation. This device can be installed in a model train at manufacturing time to keep costs minimal. Model train enthusiasts may desire remote control operation, and with the present invention, the enthusiast will be easily able to insert an industry standard remote control device into the provided connector. When inserted, the basic operation is enhanced to support the remote features provided by the remote control device. Additionally, augmentation is performed by the present invention to enhance the lighting and motor throttle granularity for more prototypical operation.

The industry standard remote control device has limited lighting capability, which is overcome by the on-board circuitry of the present invention. The industry standard remote control device has a 32-step motor throttle, which is quite limiting. The present invention enhances the motor throttle increment to 100-steps, which may be enabled or disabled at will. The present invention may be licensed for specific manufacturing needs as required.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Referring now descriptively to the drawings, the attached figures illustrate a Model Train Direction Control device.

The invention consists of a printed circuit board with various input and output connections. Inputs are attached to a power source, and outputs are attached to the various lights and motors in the model train. A 24-pin socket is provided for the industry standard remote control device, which is a printed circuit board with a connector. The present invention comprises several sections broken down in logical sections shown in FIG. 1 to FIG. 4.

Figure 1:
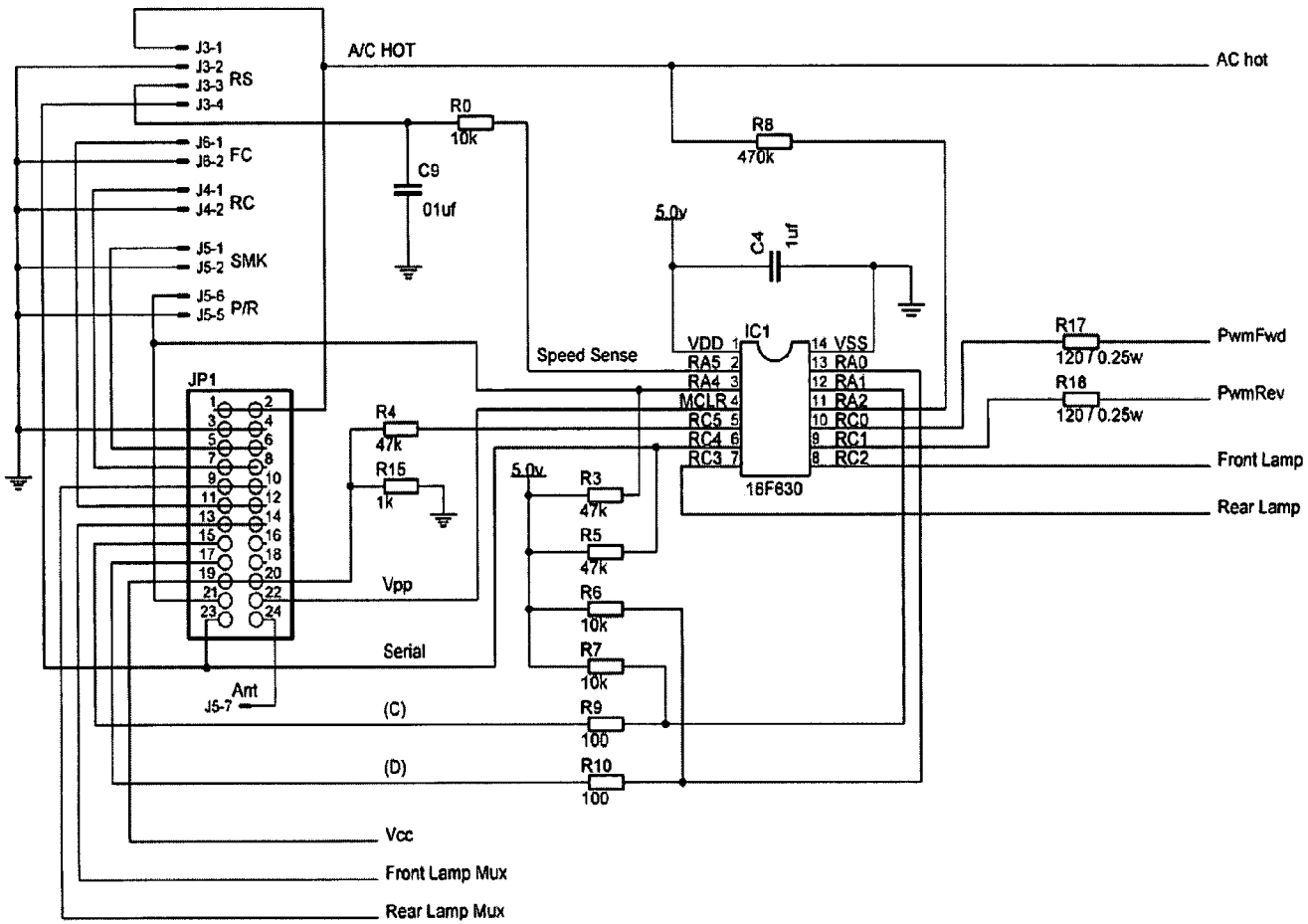
FIG. 1 is a diagrammatic view of the microprocessor and connector that detects and receives the industry standard remote control device of the present invention.

Referring to FIG. 1, JP1 is the connector for the industry standard remote control device.

Connectors labeled RS, FC, RC, and SMK are for the advanced features of the remote control device and are made available for optional features not related to the scope of the present invention.

Connector P/R is connected to a switch labeled "program/run", and is used by the inserted remote control device and by the present invention. The switch position indicates user operational preferences.

The heart of the operation of the present invention is represented by the microprocessor IC1. This microprocessor controls the lighting and motor signals during operation.

The presence of the remote control device on JP1 is detected by the microprocessor (IC1) pin 5 connection logic level. Normally this pin is pulled to logic low by R15. When the remote control device is inserted, JP1 pins #19 and #20 supply 5 v to overcome the logic low on the microprocessor (IC1) pin 5. This detection mechanism is unique, and dictates the behavior of the present invention allowing the lighting and motor operations to be properly controlled with and without the remote control device inserted.

The following describes the operation without the remote control device being inserted. Microprocessor (IC1) samples the alternating current power signal, AC hot, through resistor R8 on pin 11. This signal transitions through zero volts every 8.33 milliseconds. The lack of this signal transitioning indicates the user has interrupted power to request a direction change. This interruption is typically 1 to 2 seconds long. If the interruption is greater than 4 seconds, the microprocessor (IC1) will lose power completely and reset to initial conditions. If the power interruption is within the 1 to 2 second time frame, the lack of transitions on pin 11 can be detected. This detection results in maintaining an internal state in microprocessor (IC1) to determine directional lighting and motor operation. There are 4 distinct states, which advance from 1) Neutral (initial), to 2) Forward, to 3) Neutral, to 4) Reverse; or commonly referred to as "N"-"F"-"N"-"R". This behavior is the expected operation of a model train.

The sequencing of these states activates various driver circuits controlled by the microprocessor (IC1). In state "N", both front lamp and the rear lamp are active. When the model train is moving forward, the front lamp is on, and when the model train moves in reverse the rear lamp is on.

Figure 2:
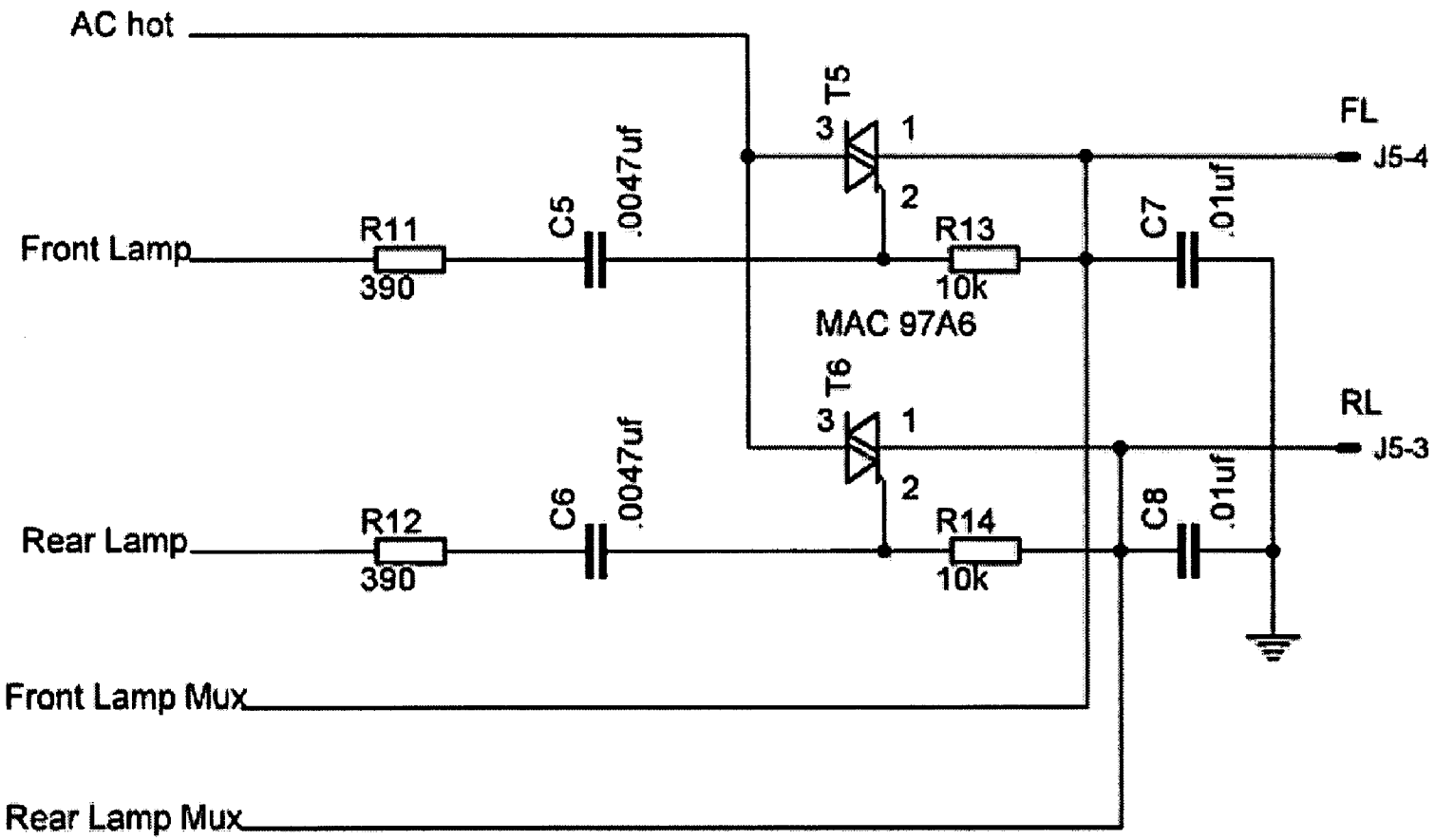
FIG. 2 is a diagrammatic view of the specialized lamp driver circuit of the present invention.

Referring to FIG. 2, the "Front Lamp" and "Rear Lamp" signals from the microprocessor (IC1) in FIG. 1 activate T5 and T6 respectively. The T5 component and the T6 component apply power from the "AC hot" to the FL and RL outputs when active. A front lamp is attached to FL, and a rear lamp is attached to RL, and they are lit appropriately. As the states step through the N-F-N-R sequence, state "F" will enable only the front lamp (FL) output, and state "R" will only enable the rear lamp (RL) output.

In concert with this sequencing of the lamps, the motor is sequenced in a similar way. The microprocessor motor control signals, PWMFwd and PWMRev, activate circuitry shown in FIG. 3 that is capable of driving AC or DC motors. When PWMFwd is active in state "F", the devices OP2 and OP3 activate T2 and T3, which delivers a polarity sensitive voltage to J2 causing the motor to move the model train forward. When PWMRev is active in state "R", similarly devices OP1 and OP4 activate T1 and T4 to deliver an opposite polarity voltage to move the model train in reverse.

In some situations it is desirable to lock the direction into state 2, "F", or state 4, "R". This is accomplished by sensing the logic level on the microprocessor (IC1) pin 3. This pin is routed to connector "P/R", which an on-off switch is normally attached. When the switch is open, pin 3 is connected to logic high by R3. When the switch is closed, pin 3 is logic low, and the internal state is "locked" into the last direction traveled. This locked state is also stored internally in the microprocessor non-volatile storage area to survive extended power interruptions.

The following describes the operation with the remote control device being inserted. As described earlier, this mode of operation is entered when the microprocessor (IC1) pin 5 has detected the remote control device. Several changes occur in the behavior of the microprocessor (IC1) outputs in this mode.

Referring to FIG. 1, the Front Lamp and Rear Lamp signals from the microprocessor (IC1) will de-activate. This effectively switches the lamp control completely over to the remote control device via signals Front Lamp Mux and Rear Lamp Mux from JP1. Uniquely leveraging the lighting output stage of the present invention shown in FIG. 2, specifically C7 and C8, the remote control device is capable of supporting a wider variety of lamp types, especially Light Emitting Diodes (LEDs).

Figure 3:
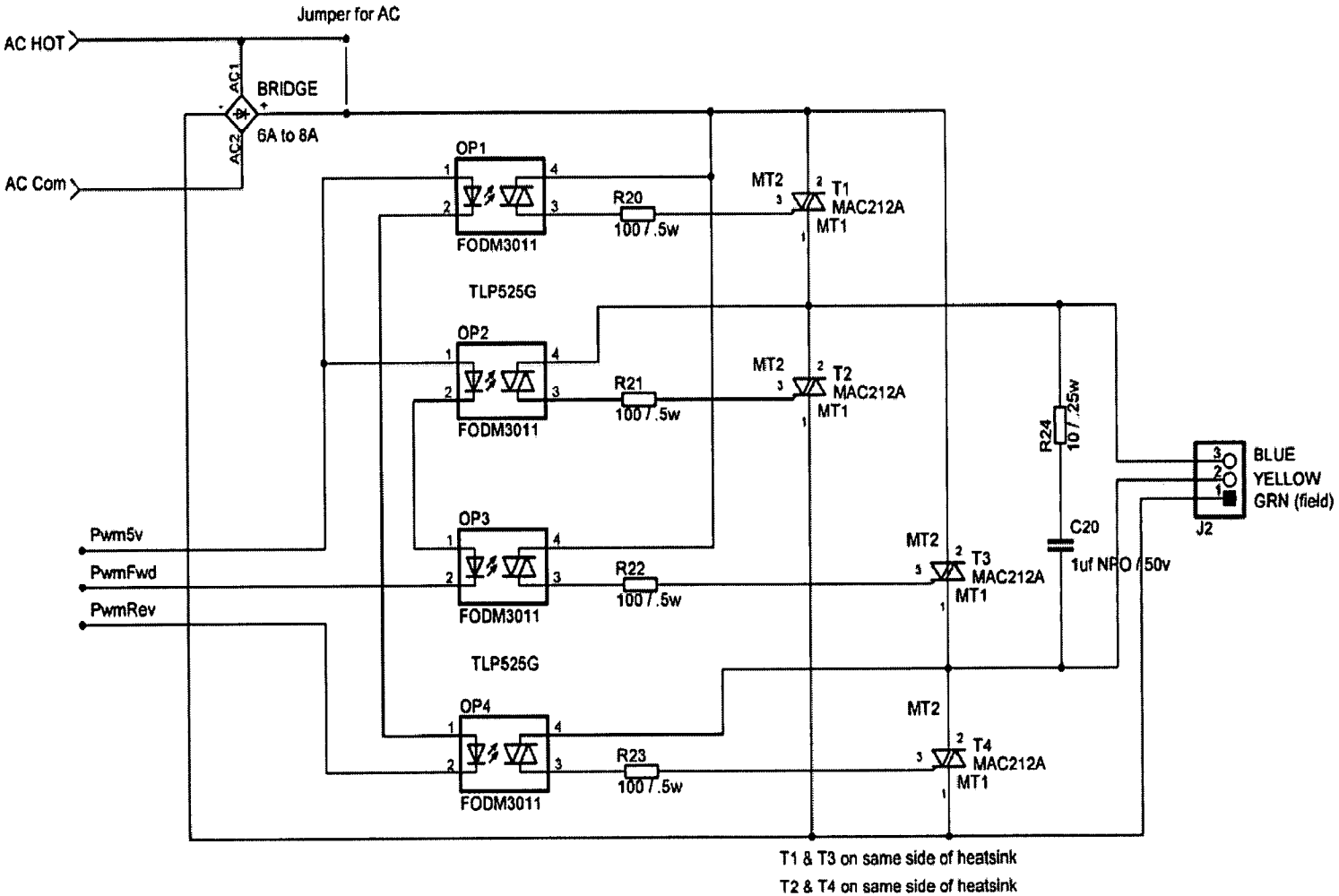
FIG. 3 is a diagrammatic view of the motor driver circuit of the present invention.

However, the motor control circuit in FIG. 3 is not released to the inserted remote control device. This is how the speed step augmentation is accomplished. The remote control device motor control signals emanate from JP1 pins 15 and 17. These signals are now fed into the microprocessor (IC1) on pins 12 and 13 respectively. The microprocessor (IC1) pin 12 will be active on forward motion requests, and microprocessor (IC1) pin 13 will be active on reverse motion requests. These signals are interpreted to determine the direction of motion requested by the remote control device.

In the compatibility mode of 32 speed steps, the microprocessor (IC1) simply repeats these signals on PWMFwd or PWMRev as needed to effect the appropriate speed and direction the remote control device is indicating. This is for compatibility with model trains not equipped with the present invention.

When the preferred 100 speed step operation is selected via a special key presses on the remote control device companion transmitter, a different sequence of events unfold. Along with the JP1 pin 15 and 17 signals; JP1 pin 23 is additionally monitored by microprocessor (IC1) pin 6. This signal on JP1 pin 23 outputs RAW commands received in a serial data stream for external use. The throttle commands present in this serial data stream were originally intended to activate a sound system to add realism by changing the RPM sounds as the model train speed changes in response to the throttle commands. This serial signal on JP1 pin 23 can be used to monitor the raw throttle requests and modify the actual speed steps applied to the motor. This augmentation, unique to the present invention, is the most sought after enhancement for the current remote control devices.

With or without the remote control device inserted, the present invention has provisions for maintaining model train speed under varying load and terrain conditions. Rotational feedback from the motor (externally provided) in the form of pulses based on motor speed is injected via "RS" connector into the "Speed Sense" connection of the microprocessor (IC1), pin 2. As the motor is directly connected to the wheels of the model train, as the model train wheel speed varies, so does the pulse rate into the microprocessor (IC1) pin 2. With this information, IC1 can adjust the motor voltage up or down to maintain a constant speed of the model train. The motor voltage is controlled by setting the "on" versus "off" time during the power cycle, commonly referred to as pulse width modulation or PWM. The effective voltage varies in concert, thus changing the motor speed. Specifically, more "on" time results in a faster running motor. This synchronization relative to the power cycle is also obtained from the signal R8 presents to the microprocessor (IC1) pin 11.

Figure 4:
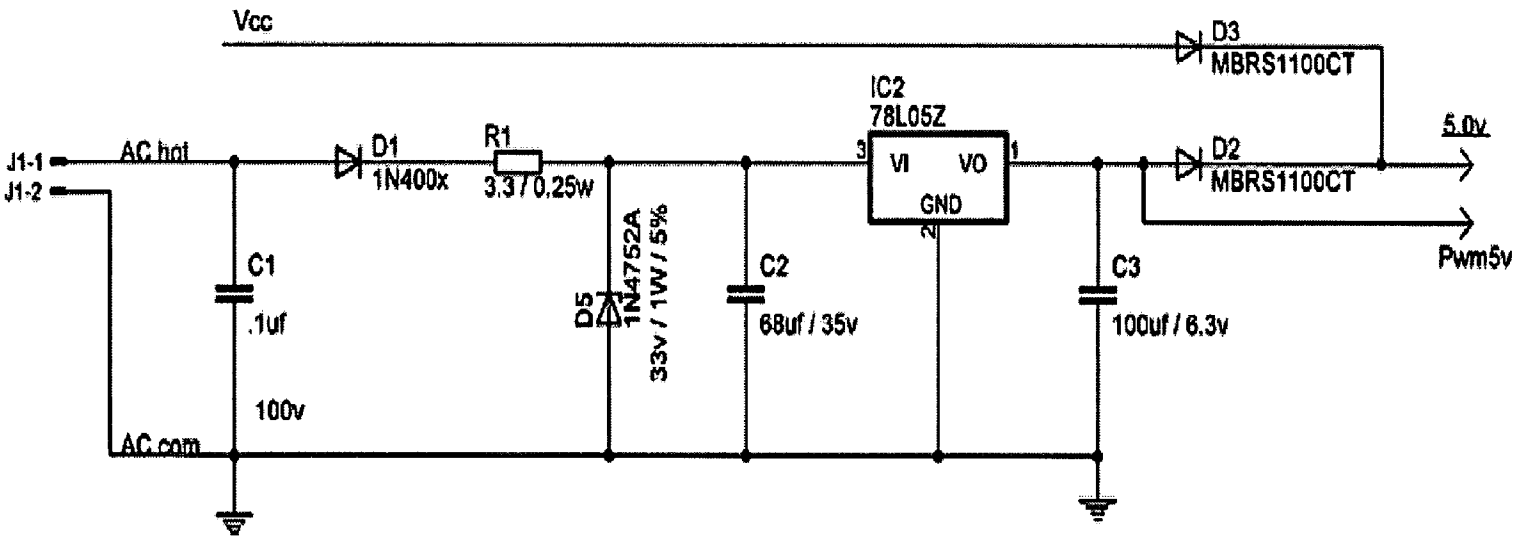
FIG. 4 is a diagrammatic view of the power supply of the present invention.

FIG. 4 is the power supply for the present invention. This is a very common design, with only one noteworthy feature. Capacitor C3 is utilized to maintain power to the microprocessor (IC1) during the brief interruptions used to indicate a request to change direction described earlier. Diodes D2 and D3 are used to route the power only to the microprocessor during these brief interruptions.

It is understood that the preceding description is given merely by way of illustration and not in limitation of the invention and that various modifications may be made thereto without departing from the spirit of the invention as claimed.

What is claimed is:

1. A model electric train direction control device comprising:

a printed circuit board positioned and connected in an electric train, the printed circuit board comprising a plurality of input electrical connections attached to a power supply and a plurality of electrical output connections attached to a number of lights and motors in a model electric train;

a microprocessor attached to one of the plurality of electrical output connectors, the microprocessor comprising at least one circuit to control lighting signals during operation and at least one circuit to control motor signals during operation, the microprocessor being programmable to control the signals automatically;

a remote control ready socket for receiving an industry standard remote control therein and an output connector attached to the remote control ready socket;

a remote control sensor attached to the remote control ready socket and connected to the microprocessor by a first pin connection, the first pin connection to the remote control sensor normally set to logic low by a second pin connection so that the microprocessor circuits control the motors and lights of the model electric train automatically according to programmed input to the microprocessor; and with an industry standard remote control positioned in the remote control ready socket, further comprising a third pin connection programmed to act with the second pin connection to set the first pin connection to logic high to allow the remote control to take control of operation of the model electric train while allowing the lighting and motor operations to be properly controlled with and without the remote control device inserted in the remote control ready socket so that the device provides basic direction control with speed monitoring and adjustment to maintain a constant speed of the model train under varying voltage and load conditions, and upon detection of an industry standard remote control device in the provided socket, will seamlessly switch the necessary signals to permit remote control operation, including additional unique lighting and throttle features gained by the on-board microprocessor in coordination of signals with coded keyboard input using the industry standard remote control device.

2. The device of claim 1 further comprising a fourth pin connection programmed for receiving a serial data stream from the industry standard remote control, the serial data stream originally intended to activate a sound system in the model electric train for changing the RPM sounds as the model train speed changes in response to throttle commands, the fourth pin connection programmed to convert the serial data stream into a one hundred speed step operation when predetermined keystroke selections are made on the industry standard remote control.

3. The device of claim 1 wherein the remote control ready socket comprises a twenty-four pin socket to connect with the industry standard remote control device.

4. The device of claim 1 further comprising additional electrical output connectors for additional operational control functions activated be key selections on the industry standard remote control.

5. The device of claim 1 wherein the microprocessor further comprises a nonvolatile memory for storing programmed commands to survive power outages.

6. The device of claim 1 further comprising additional output connectors programmed to enable use of the industry standard remote control device to support a wide variety of lamp types.

7. The device of claim 6 wherein one of the wide varieties of lamp types comprises Light Emitting Diodes.

8. The device of claim 1 further comprising a switch used by the inserted industry standard remote control device and by the model electric train control device to indicate user operational preferences.

9. The device of claim 1 further comprising a timing sensor to detect variation in power interruptions timed signals for varying operational control.

10. The device of claim 9 wherein the power supply further comprises a capacitor to maintain power to the microprocessor during the power interruptions timed signals and diodes to route power only to the microprocessor during these power interruptions.

* * * * *